US009060554B2

(12) United States Patent
Bullard

(10) Patent No.: US 9,060,554 B2
(45) Date of Patent: Jun. 23, 2015

(54) METHOD AND SYSTEM FOR HOLDING NAILS

(71) Applicant: DolphinGrips LLC, Moriarty, NM (US)

(72) Inventor: Ivy Bullard, Moriarty, NM (US)

(73) Assignee: DolphinGrips LLC, Moriarty, NM (US)

( * ) Notice: Subject to any disclaimer, the term of this patent is extended or adjusted under 35 U.S.C. 154(b) by 0 days.

(21) Appl. No.: 14/076,563

(22) Filed: Nov. 11, 2013

(65) Prior Publication Data

US 2014/0259281 A1 Sep. 18, 2014

Related U.S. Application Data

(60) Provisional application No. 61/789,512, filed on Mar. 15, 2013.

(51) Int. Cl.

| | |
|---|---|
| ***B25C 3/00*** | (2006.01) |
| ***A41D 19/015*** | (2006.01) |
| ***A41D 13/08*** | (2006.01) |

(52) U.S. Cl.

CPC ..... *A41D 19/01594* (2013.01); *A41D 13/087* (2013.01); *B25C 3/008* (2013.01); *A41D 19/01547* (2013.01)

(58) Field of Classification Search

CPC ..... A41D 19/01594; A41D 13/087; B25C 3/008; B25C 3/00

USPC ..... 81/44, 488, 436, 451, 454, 455; 2/16–21, 159–161.8, 163; 131/258, 131/329, 257, 330, 187; 294/99.2; 146/46; 623/57, 64, 65, 66.1; 206/338, 340, 206/349

See application file for complete search history.

(56) References Cited

U.S. PATENT DOCUMENTS

| | | | | |
|---|---|---|---|---|
| 337,905 | A | 3/1886 | Wheelock | |
| 2,348,962 | A | 5/1944 | Davis | |
| 2,420,869 | A | 5/1947 | Davis | |
| 2,438,989 | A * | 4/1948 | Billman | 269/221 |
| 2,467,613 | A | 4/1949 | Davis | |
| 2,530,688 | A | 11/1950 | Ducot | |
| 2,563,677 | A * | 8/1951 | Frazier | 294/99.2 |
| 2,788,817 | A | 4/1957 | Leniz | |
| 2,878,476 | A | 3/1959 | Auchard | |
| 3,293,958 | A | 12/1966 | Smith | |
| 3,729,035 | A | 4/1973 | Manzanarez | |
| 3,913,646 | A | 10/1975 | Grayson | |
| 4,079,765 | A | 3/1978 | Hatayan | |
| 4,796,302 | A * | 1/1989 | Davis et al. | 2/21 |
| 4,926,718 | A * | 5/1990 | Cook | 81/44 |
| 5,234,142 | A * | 8/1993 | Loewen et al. | 223/101 |

(Continued)

FOREIGN PATENT DOCUMENTS

| | | | |
|---|---|---|---|
| DE | 43 02 559 A1 | 8/1994 | |
| DE | 4302559 A1 * | 8/1994 | B25C 3/00 |

*Primary Examiner* — Hadi Shakeri
*Assistant Examiner* — Melanie Alexander
(74) *Attorney, Agent, or Firm* — Kevin Soules; Luis M. Ortiz; Kermit D. Lopez

(57) ABSTRACT

A method, system, and apparatus for holding a connecting instrument comprises a first member including a first finger cup and a first needle nose tip formed on the forward end of the finger cup and a second member comprising a second finger cup and a second needle nose tip formed on the forward end of the second finger cup wherein the first needle nose tip and the second needle nose tip are configured to grip a connecting device as it is being driven into a target.

4 Claims, 5 Drawing Sheets

(56) References Cited

U.S. PATENT DOCUMENTS

| | | | | |
|---|---|---|---|---|
| 5,375,488 | A | 12/1994 | Baitner | |
| 5,706,520 | A * | 1/1998 | Thornton et al. | 2/21 |
| 5,893,303 | A * | 4/1999 | Harris | 81/44 |
| 6,009,557 | A * | 1/2000 | Witta | 2/159 |
| 6,098,498 | A * | 8/2000 | Ming et al. | 81/44 |
| 6,145,128 | A * | 11/2000 | Suzuki | 2/21 |
| 6,401,253 | B2 * | 6/2002 | Brunson | 2/160 |
| 6,708,582 | B1 * | 3/2004 | McJunkin et al. | 74/488 |
| 6,925,653 | B1 * | 8/2005 | King | 2/21 |
| 7,937,774 | B1 * | 5/2011 | King | 2/161.1 |
| 2002/0148031 | A1 * | 10/2002 | O'Dea et al. | 2/160 |
| 2004/0035255 | A1 | 2/2004 | Rion | |
| 2005/0086722 | A1 * | 4/2005 | Bjorntwedt | 2/161.6 |

* cited by examiner

METHOD AND SYSTEM FOR HOLDING NAILS

CROSS-REFERENCE TO PROVISIONAL APPLICATION

This application claims the benefit of priority based on U.S. Provisional Patent Application 61/789,512 filed Mar. 15, 2013 entitled "NAIL HOLDING SYSTEM". The above-referenced provisional patent application is hereby incorporated by reference in its entirety.

FIELD OF THE INVENTION

Embodiments are generally related to the field of safety devices. More particularly, embodiments relate to methods and systems for holding a nail, operated by a user's fingers.

BACKGROUND

In general, installing a nail requires a workman to hold the nail between the workman's fingers, while a hammer is used to drive the nail. This operation is well known but inherently suffers from the dangerous relationship between the workman's fingers and the driving instrument. As the workman operates the hammer, the workman's fingers are left exposed to the driving surface of the hammer. It is painfully common for the hammer to unintentionally impact a workman's fingers.

Some prior art systems have attempted to rectify these problems by providing various forms of protection for a workman's fingers. However, these inventions are often cumbersome and difficult to use, or do not provide an adequate grip on the nail to ensure it can be driven truly. Therefore, a need exists for methods and systems to protect a user's fingers while driving a nail.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for protecting a user's fingers.

It is another aspect of the disclosed embodiments to provide for an enhanced method and system for protective finger covers capable of holding a nail as it is driven.

The aforementioned aspects and other objectives and advantages can now be achieved as described herein. An apparatus for holding a connecting instrument comprises a first member comprising a first finger cup and a first needle nose tip formed on a forward end of the first finger cup and a second member comprising a second finger cup and a second needle nose tip formed on a forward end of the second finger cup. The first needle nose tip and the second needle nose tip are configured to grip a connecting device.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof. Various modifications to the preferred embodiments, disclosed herein, will be readily apparent to those of ordinary skill in the art and the disclosure set forth herein may be applicable to other embodiments and applications without departing from the spirit and scope of the present specification and the claims hereto appended. Thus, the present specification is not intended to be limited to the embodiments described, but is to be accorded the broadest scope consistent with the disclosure set forth herein.

Figure 1:
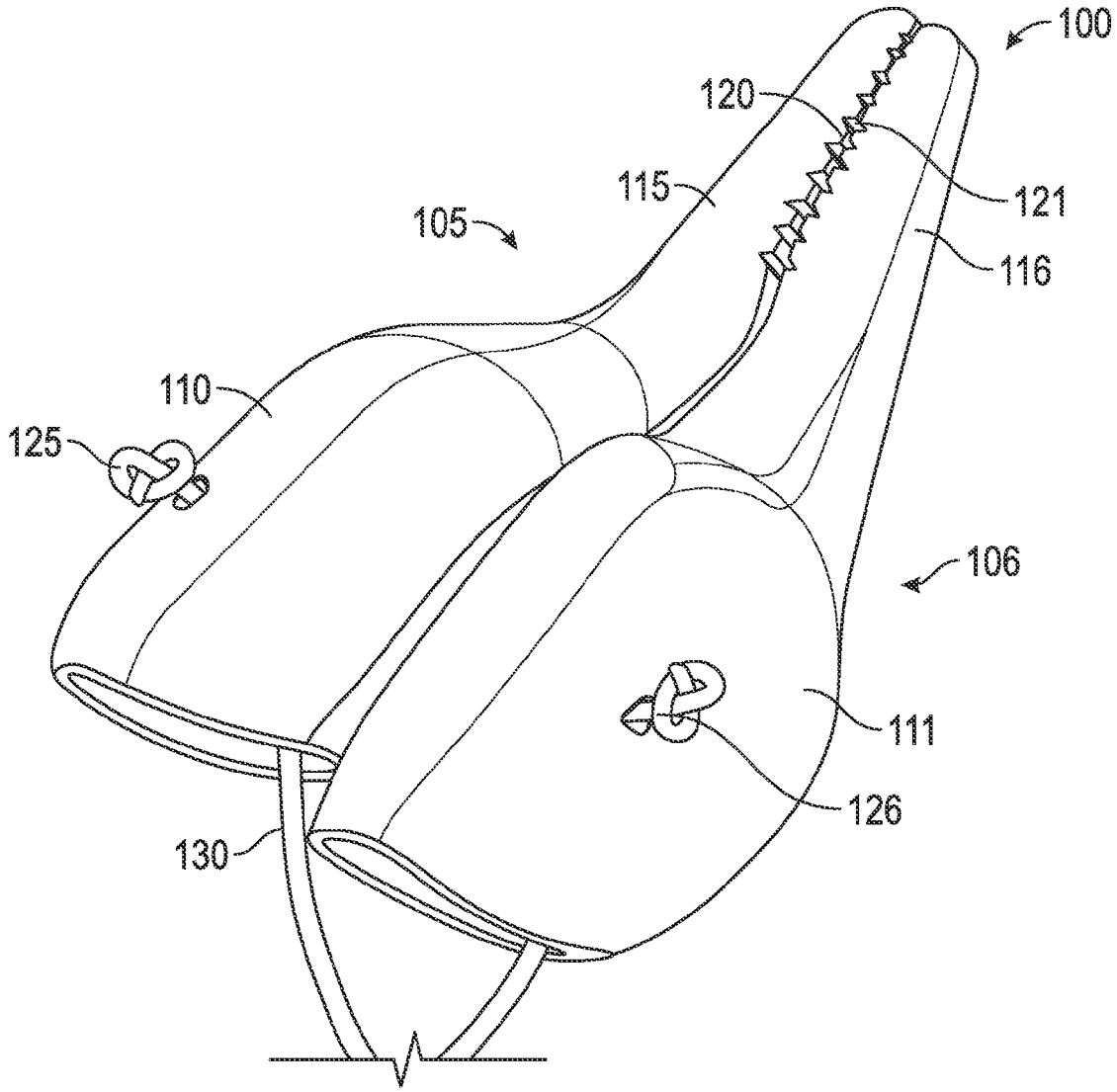
FIG. 1 depicts a top view of a system and apparatus for gripping a nail.

FIG. 1 illustrates a protective system or apparatus for gripping a nail 100 as it is driven into a target. Apparatus 100 includes a first member 105 and a second member 106. The first member 105 is a thimble like finger cup 110 with an elongated needle nose tip 115. Likewise, the second member 106 includes a thimble like finger cup 111 and an elongated needle nose tip 116. Both needle nose tips 115 and 116 include teeth 120 and 121, respectively that are formed to help hold a connecting device such as a nail, screw, rivet, tack, thumbtack, or the like as it is driven into a target.

Each of members 105 and 106 include connections 125 and 126 respectively that are connected to a lanyard 130, or other such retaining device. In an alternative embodiment, the lanyard may be connected to a wrist strap (not shown) to secure the finger cups 110 and 111 to the user's hand.

Figure 2:
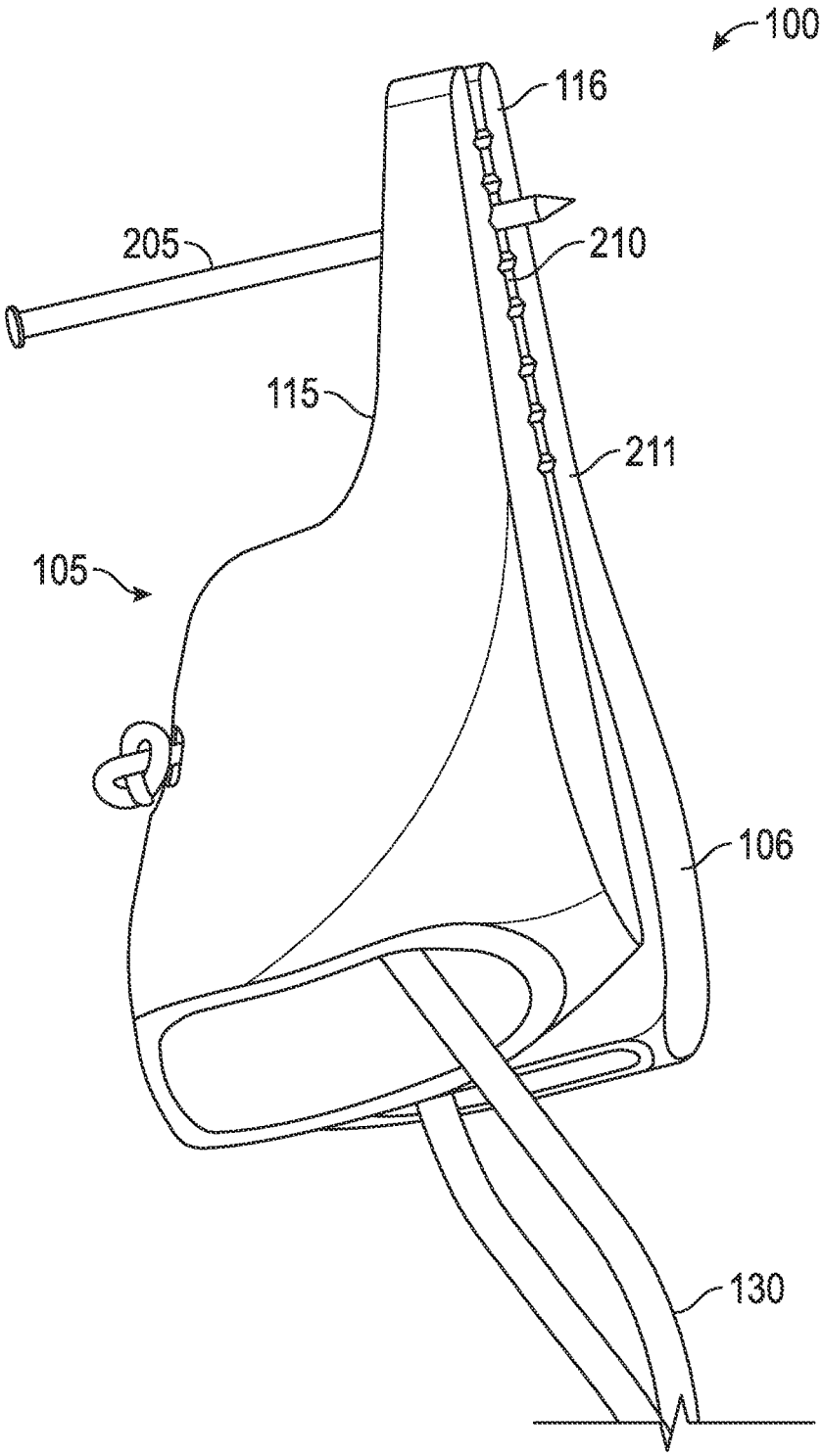
FIG. 2 depicts a side view of a system and apparatus for gripping a nail.

FIG. 2 illustrates a vertical side view of the system or apparatus 100. In this view it is clear that the exterior bottom surfaces 210 and 211 of members 105 and 106, respectively are flat. This allows the system 100 to be placed flush against a target making the system easily maneuverable to the proper position on the target.

In addition, in FIG. 2 a nail 205 is shown grasped between needle nose tips 115 and 116. Finger cup 110 illustrated in FIGS. 1 and 2 is configured to ergonomically accept a user's left index finger, and finger cup 111 is configured to ergonomically accept a user's left thumb. The internal shape of each respective finger cup is intended to fit the shape of the user's fingers and may be configured to cover the finger up to or beyond the finger's first joint. In this embodiment, it is assumed that the user is right-handed and thus would prefer to operate a driving device such as a hammer with their right hand. However, it should be appreciated that in an alternate embodiment, finger cup 110 could be configured to ergonomically accept a user's right index finger and finger cup 111 could be configured to ergonomically accept a user's right thumb. In that embodiment, it is assumed the user is left-handed. In yet another embodiment, a user can select the configuration of finger cups 110 and 111 for a left hand or a right hand as they prefer.

Figure 3:
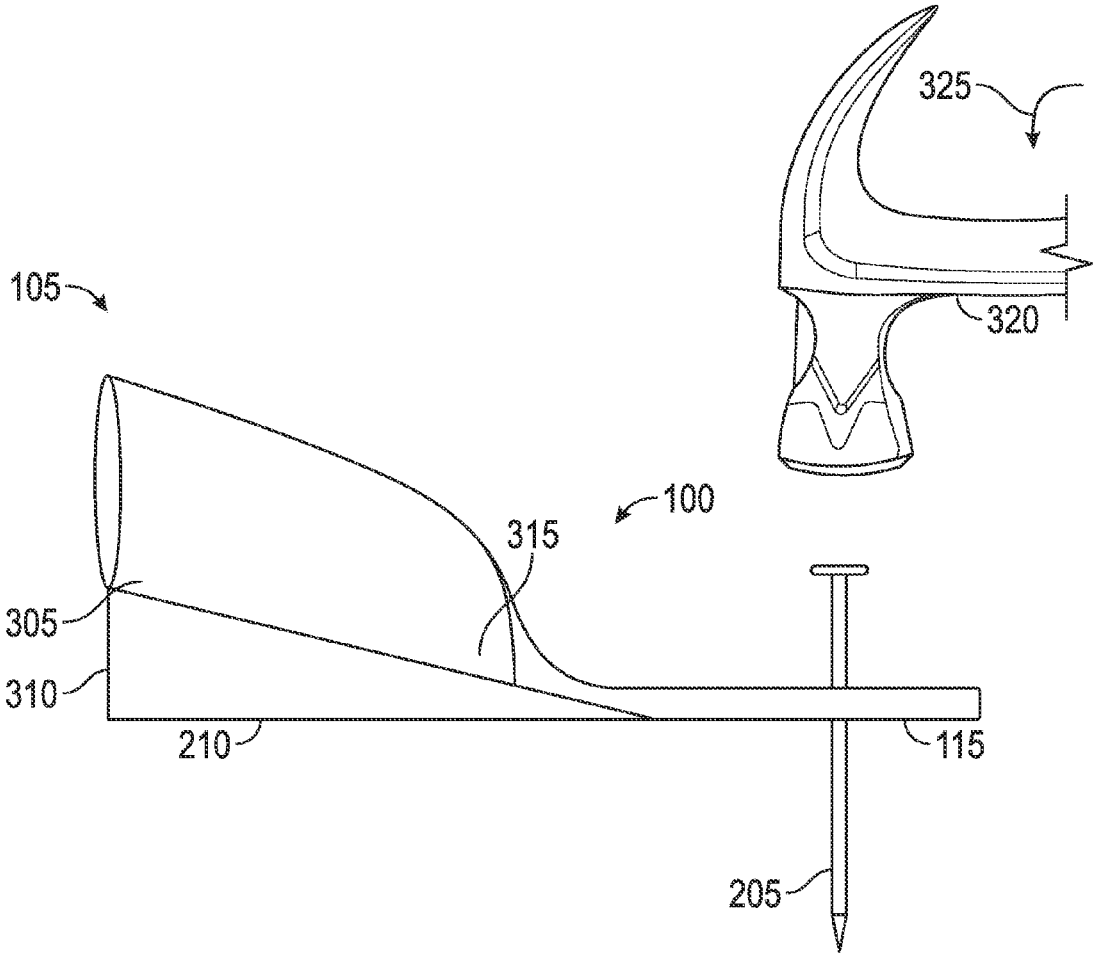
FIG. 3 depicts a side view of the internal structure comprising a system and apparatus for gripping a nail.

FIG. 3 illustrates a horizontal side view of system 100. This perspective illustrates that the interior bottom side 310 of finger cup 110 (or equivalently finger cup 111) is wedge shaped. Therefore, the interior forward side 315 is below the interior back side 305 when the member 105 (or 106) is placed flush against the target. This allows a user to slide their fingers into the respective finger cups 110 and 111 at a downward angle.

This downward angle is critically important to the ease of use of the system. In tests, when the finger cups were provided without this wedge it was exceedingly difficult to maneuver the device along a flat surface because a human hand does not naturally lie flat against the surface. However, with the wedged shape of the bottom side 310, a user can easily insert their fingers in the finger cups 110 and 111 and slide the system 100 around the surface of a flat target. Furthermore, it is essentially impossible to hold the device on the edge of a flat surface without the wedge shaped interior bottom side 310 that allows the user to insert their fingers at a downward angle.

FIG. 3 further includes an illustration of a hammer 320 being operated according to arrow 325 to drive nail 205. In this illustration, nail 205 is being gripped between needle nose tips 115 and 116. It should be appreciated that a user could preferably impart the motion on hammer 320 indicated by arrow 325, or in another direction conducive to driving the nail as the situation may dictate.

With respect to the system and apparatus shown in FIGS. 1-3, it should be appreciated that the members 105 and 106 can be constructed of any material sufficiently rigid to protect a user's fingers from the downward impact of the driving tool. Thus, the members 105 and 106 can be formed of metal such as tempered aluminum, plastic, rubber, or other polymer. In a preferred embodiment, a combination of these materials can be used. For example, finger cups 110 and 111 can be internally formed of metal and the surround be a rubber or plastic form so that the rubber or plastic form is internally reinforced by the metal. In addition, lanyard 130 can be comprised of a material including, but not limited to, an elastic polymer, leather, and cloth, either alone or in combination.

Figure 4:
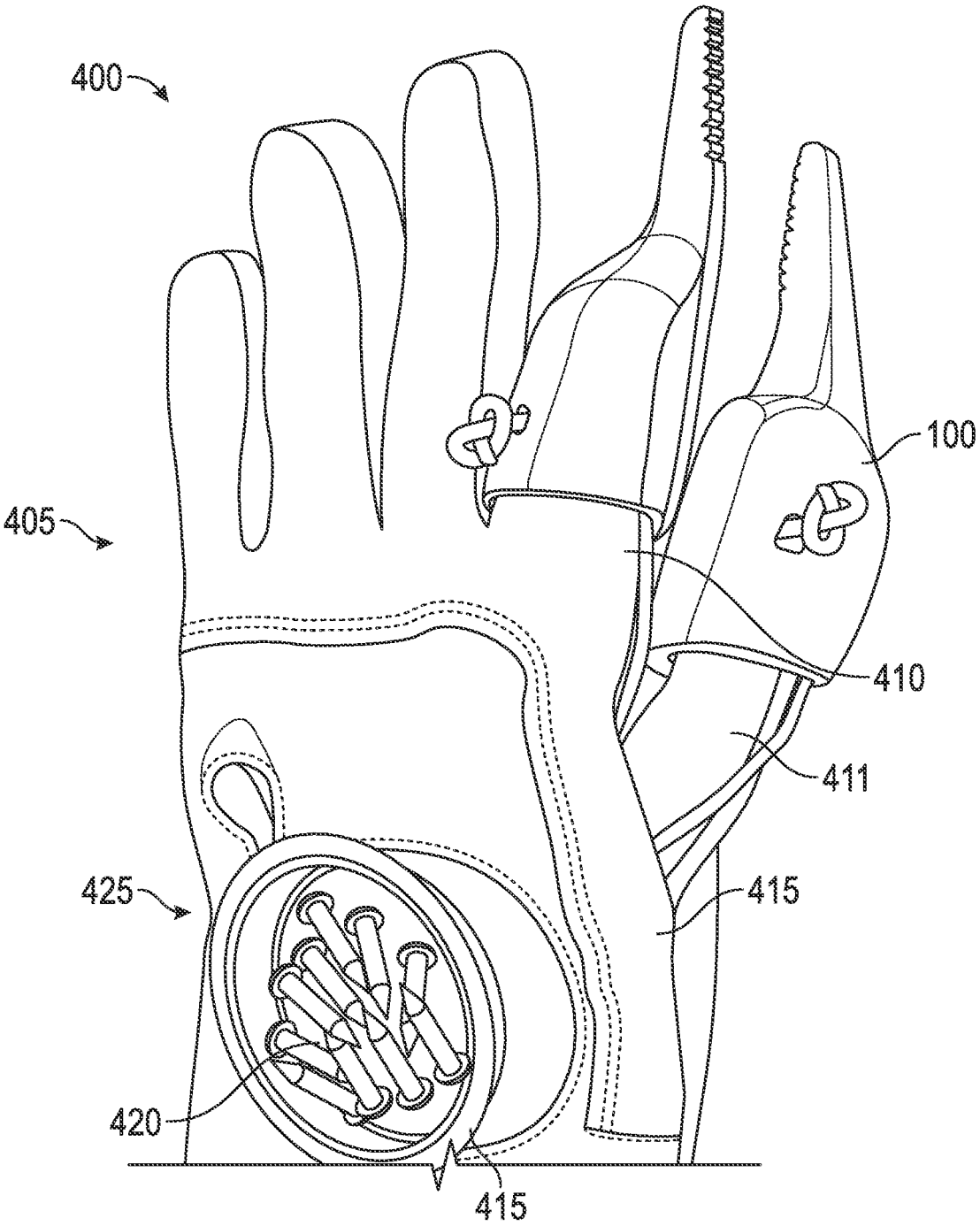
FIG. 4 depicts a top view of a system and apparatus for gripping a nail in accordance with an alternative embodiment.

FIG. 4 illustrates an alternative embodiment 400 of the method and apparatus. Specifically FIG. 4 illustrates a glove 405. Glove 405 can be configured to include the protective system or apparatus for gripping a nail 100 at the end of the glove's index finger 410 and the glove's thumb 411. In this embodiment, a user can insert their hand into a glove 405. The user's index finger and thumb naturally slide into finger cups 110 and 111 as their hand engages the glove 405.

Glove 405 includes a magnetized cup 415. The magnetized cup 415 can preferably be located on the upper palm side 425, or lower palm side of the glove 405. The magnetized cup 415 is configured to hold a plurality of unused nails 420, screws, rivets, tacks, thumbtacks, or the like. The magnetization of magnetized cup 415 ensures these spare nails 420 are not spilled as the user maneuvers their hands to complete a job. In this way the system or apparatus 400 provides a user protection for their fingers as they drive a connecting device into a target as well as the convenience of keeping a supply of connecting devices, such as nails 420, readily available to be inserted into the target as need.

It should be appreciated that FIG. 4 illustrates a left-handed glove 405. Any skilled artisan will appreciate that this design is equally applicable to a right-handed glove according to user preference.

Figure 5:
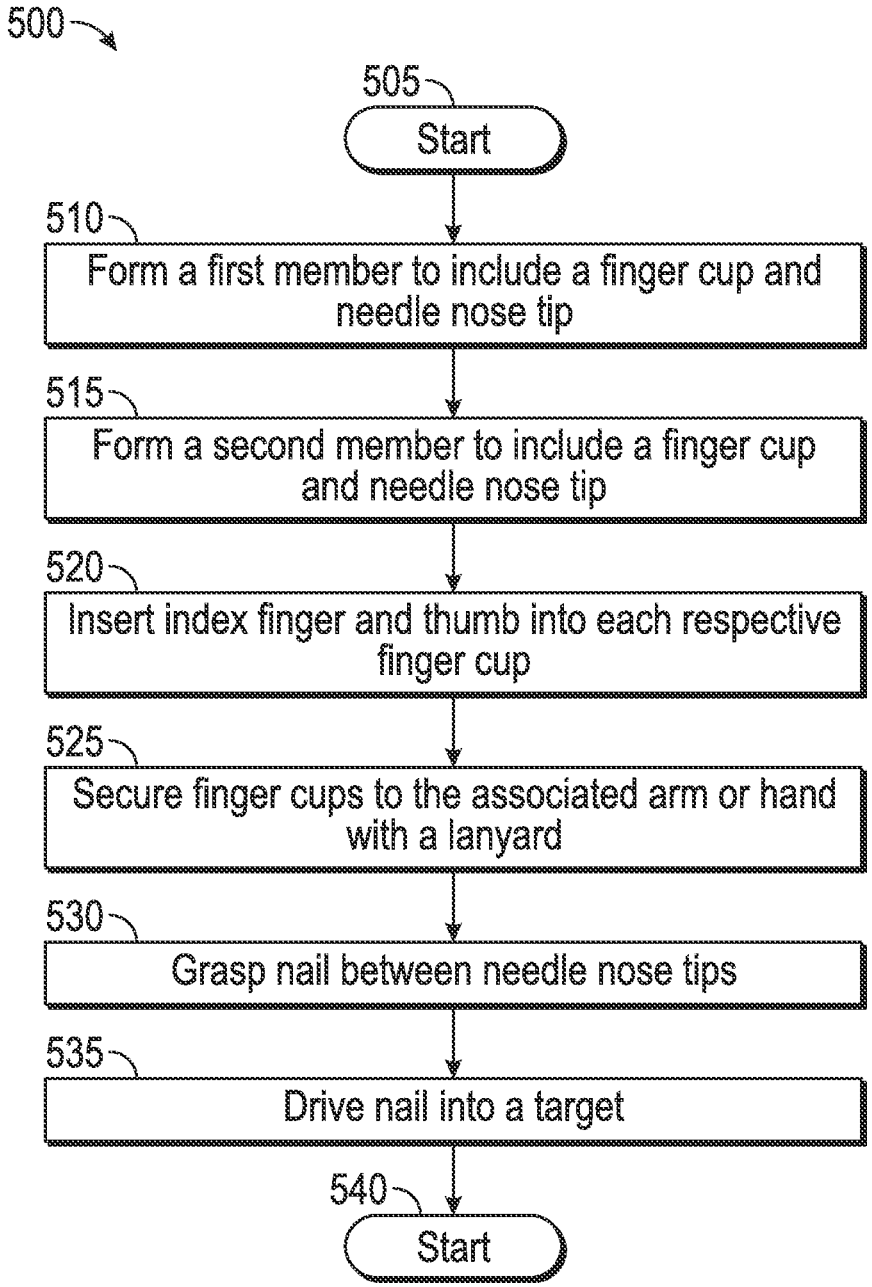
FIG. 5 depicts a high level flow chart illustrating logical operational steps for protecting one's fingers as a nail is driven.

FIG. 5 illustrates a flow chart 500 of logical operational steps for protecting a workman's fingers as a connecting device is being driven into a target in accord with an alternate embodiment of the invention. The method begins at block 505.

The first step is to form a first member 105 to include a finger cup 110 and a needle nose tip 115, as shown at block 510. Next, at block 515, a second member 106 can be formed to include a finger cup 111 and a needle nose tip 116. It should be appreciated that in an alternative embodiment, these steps may include forming a glove such as glove 405 to include first and second members 105 and 106.

A user can then insert their index finger and thumb into each of finger cups 110 and 111 to engage system 100, as illustrated by block 520. Preferably, the user also secures the finger cups 110 and 111 to the user's arm or hand with lanyard 130, as shown at block 525.

Once the system 100 has been secured to the user's person, a nail 205 can be inserted between needle nose tips 115 and 116. At block 530, the nail 205 is gripped between needle nose tips 110 and 111 by the application of force on member's 105 and 106 by the user's fingers. The teeth 120 and 121 help ensure the nail 205 does not slip from between the needle nose tips 115 and 116.

At this stage the nail is ready to be driven into the target, as illustrated at block 535. The user may operate a driving tool such as a hammer or drill to drive the nail (or screw) 205 into the target. The user need not worry about the safety of their fingers should the driving device miss the dead of the nail 205 as the system 100 is protecting the user's fingers from any accidental impact. The method ends at block 540.

Based on the foregoing, it can be appreciated that a number of embodiments, preferred and alternative, are disclosed herein. For example, in one embodiment, an apparatus for holding a connecting instrument comprises a first member comprising a first finger cup and a first needle nose tip formed on a forward end of the first finger cup and a second member comprising a second finger cup and a second needle nose tip formed on a forward end of the second finger cup. The first needle nose tip and the second needle nose tip are configured to grip a connecting device.

In another embodiment the apparatus includes an interior bottom side of the first finger cup and an interior bottom side of the second finger cup formed with a wedge shape such that an interior forward end of the first finger cup and an interior forward end of the second finger cup are lower than the interior back end of the first finger cup and the interior back end of the second finger cup. Furthermore, an exterior bottom side of the first member and an exterior bottom side of the second member are flat.

The apparatus also includes first finger cup configured to ergonomically accept a user's index finger and the second finger cup is configured to ergonomically accept a user's thumb.

In an alternative embodiment, a retaining device is connected to an exterior surface of the first finger cup and an exterior surface of the second finger cup, and further configured to attach to a user, thereby preventing said apparatus from being dropped. The first needle nose tip and the second needle nose tip further comprise a plurality of teeth for gripping a connecting device.

In another alternative embodiment of the apparatus, the first member and the second member are formed of at least one of metal, plastic, rubber, and nylon. The connecting device comprises a nail, a screw, a rivet, a thumbtack, or a tack.

In an alternative embodiment, the apparatus further comprises a glove wherein the first member and the second member are formed in a thumb and a forefinger of the glove, and a magnetized holding cup is configured on the glove wherein the magnetized holding cup is configured to hold at least one spare connecting device.

In another alternative embodiment, an apparatus for holding a connecting instrument comprises a first member comprising a first finger cup and a first needle nose tip formed on a forward end of the first finger cup, a second member comprising a second finger cup and a second needle nose tip formed on a forward end of the second finger cup wherein the first needle nose tip and the second needle nose tip are configured to grip a connecting device. The apparatus further comprises an interior bottom side of the first finger cup and an interior bottom side of the second finger cup formed with a wedge shape such that an interior forward end of the first finger cup and an interior forward end of the second finger cup are lower than an interior back end of the first finger cup and an interior back end of the second finger cup and an exterior bottom side of the first member and an exterior bottom side of the second member are flat.

In yet another embodiment of the apparatus, the first finger cup is configured to ergonomically accept a user's index finger and the second finger cup is configured to ergonomically accept a user's thumb.

The apparatus further comprises a retaining device connected to an exterior surface of the first finger cup and an exterior surface of the second finger cup, and is further configured to attach to a user, thereby preventing the apparatus from being dropped.

In another preferred embodiment the first needle nose tip and the second needle nose tip further comprise a plurality of teeth for gripping the connecting device. The first member and the second member are formed of at least one of metal, plastic, rubber, and nylon. In addition, the connecting device comprises a nail, a screw, a rivet, a thumbtack, or a tack.

In an alternative embodiment, a system for holding a connecting instrument comprises a first member comprising a first finger cup and a first needle nose tip formed on a forward end of the first finger cup and a second member comprising a second finger cup and a second needle nose tip formed on a forward end of the second finger cup wherein the first needle nose tip and the second needle nose tip are configured to grip a connecting device. In addition, an interior bottom side of the first finger cup and an interior bottom side of the second finger cup are formed with a wedge shape such that an interior forward end of the first finger cup and an interior forward end of the second finger cup are lower than an interior back end of the first finger cup and an interior back end of the second finger cup. An exterior bottom side of the first member and an exterior bottom side of the second member are flat. The first finger cup is configured to ergonomically accept a user's index finger and the second finger cup is configured to ergonomically accept a user's thumb.

In another embodiment the system comprises a retaining device connected to an exterior surface of the first finger cup and an exterior surface of the second finger cup, and is further configured to attach to a user, thereby preventing the system from being dropped. The first needle nose tip and the second needle nose tip further comprise a plurality of teeth for gripping a connecting device.

In another embodiment the first member and the second member are formed of at least one of metal, plastic, rubber, and nylon.

The system further comprises a glove wherein the first member and the second member are formed in a thumb and a forefinger of the glove and the glove includes a magnetized holding cup configured on the glove wherein said magnetized holding cup is configured to hold at least one spare connecting device.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A system for holding a connecting instrument comprising:

a first member comprising a first finger cup and a first needle nose tip formed on a forward end of said first finger cup;

a second member comprising a second finger cup and a second needle nose tip formed on a forward end of said second finger cup wherein said first needle nose tip and said second needle nose tip are configured to grip a connecting device;

an interior bottom side of said first finger cup and an interior bottom side of said second finger cup formed with a wedge shape such that an interior forward end of said first finger cup and an interior forward end of said second finger cup are lower than an interior back end of said first finger cup and an interior back end of said second finger cup;

an exterior bottom side of said first member and an exterior bottom side of said second member are flat, wherein said first finger cup is configured to ergonomically accept a user's index finger and said second finger cup is configured to ergonomically accept a user's thumb;

a glove wherein said first member and said second member are formed in a thumb and a forefinger of said glove; and a magnetized holding cup configured on said glove wherein said magnetized holding cup is configured to hold at least one spare connecting device.

2. The system of claim 1 further comprising a retaining device connected to an exterior surface of said first finger cup and an exterior surface of said second finger cup, and further configured to attach to a user, thereby preventing said apparatus from being dropped.

3. The system of claim 2 wherein said first needle nose tip and said second needle nose tip further comprise a plurality of teeth for gripping said connecting device.

4. The system of claim 3 wherein said first member and said second member are formed of at least one of:

metal;
plastic;
rubber; and
nylon.

* * * * *